United States Patent [19]

Diaz-Kotti

[11] Patent Number: 4,798,760

[45] Date of Patent: Jan. 17, 1989

[54] SUPERIMPOSED WET PRESS FELT

[75] Inventor: Michelle A. Diaz-Kotti, Johnston, S.C.

[73] Assignee: Asten Group, Inc., Charleston, S.C.

[21] Appl. No.: 94,703

[22] Filed: Sep. 9, 1987

[51] Int. Cl.[4] ..... B32B 5/02

[52] U.S. Cl. ..... 428/234; 28/107; 139/383 A; 162/DIG. 1; 162/358; 428/247; 428/252; 428/280; 428/282; 428/300; 428/284

[58] Field of Search ..... 428/234, 247, 252, 280, 428/282, 300, 284; 162/DIG. 1, 358; 139/383 A; 28/107

[56] References Cited

U.S. PATENT DOCUMENTS

| | | | |
|---|---|---|---|
| 3,772,746 | 11/1973 | Ivanowicz | 28/72.2 R |
| 4,187,618 | 2/1980 | Diehl | 34/243 F |
| 4,356,225 | 10/1982 | DuFour | 428/234 |
| 4,357,386 | 11/1982 | Luciano et al. | 428/234 |
| 4,425,392 | 1/1984 | Oikawa et al. | 428/90 |
| 4,427,734 | 1/1984 | Johnson | 428/234 |
| 4,461,803 | 7/1984 | Booth et al. | 428/234 |
| 4,482,601 | 11/1984 | Hartigan, Jr. | 428/234 |
| 4,500,588 | 2/1985 | Lundstrom | 428/212 |
| 4,503,113 | 3/1985 | Smart | 428/282 |
| 4,520,059 | 5/1985 | Worrall et al. | 428/109 |
| 4,528,236 | 7/1985 | Finn et al. | 428/222 |
| 4,533,594 | 8/1985 | Buchanan | 428/282 |
| 4,537,816 | 8/1985 | Booth et al. | 428/282 |
| 4,579,771 | 4/1986 | Finn et al. | 428/222 |
| 4,601,942 | 7/1986 | Finn et al. | 428/282 |

FOREIGN PATENT DOCUMENTS

| | | | |
|---|---|---|---|
| 691463 | 7/1964 | Canada | 28/79 |

*Primary Examiner*—James J. Bell

*Attorney, Agent, or Firm*—Volpe and Koenig

[57] ABSTRACT

An improved wet press felt for a papermaking machine which includes a woven base layer, a layer of monofilament fiber mesh oriented adjacent the woven base and at least one layer of non-woven batt material affixed to the combination of woven base layer and mesh layer. When a plurality of layers of non-woven batt material are employed, a layer of mesh is oriented between adjacent batt layers.

15 Claims, 1 Drawing Sheet

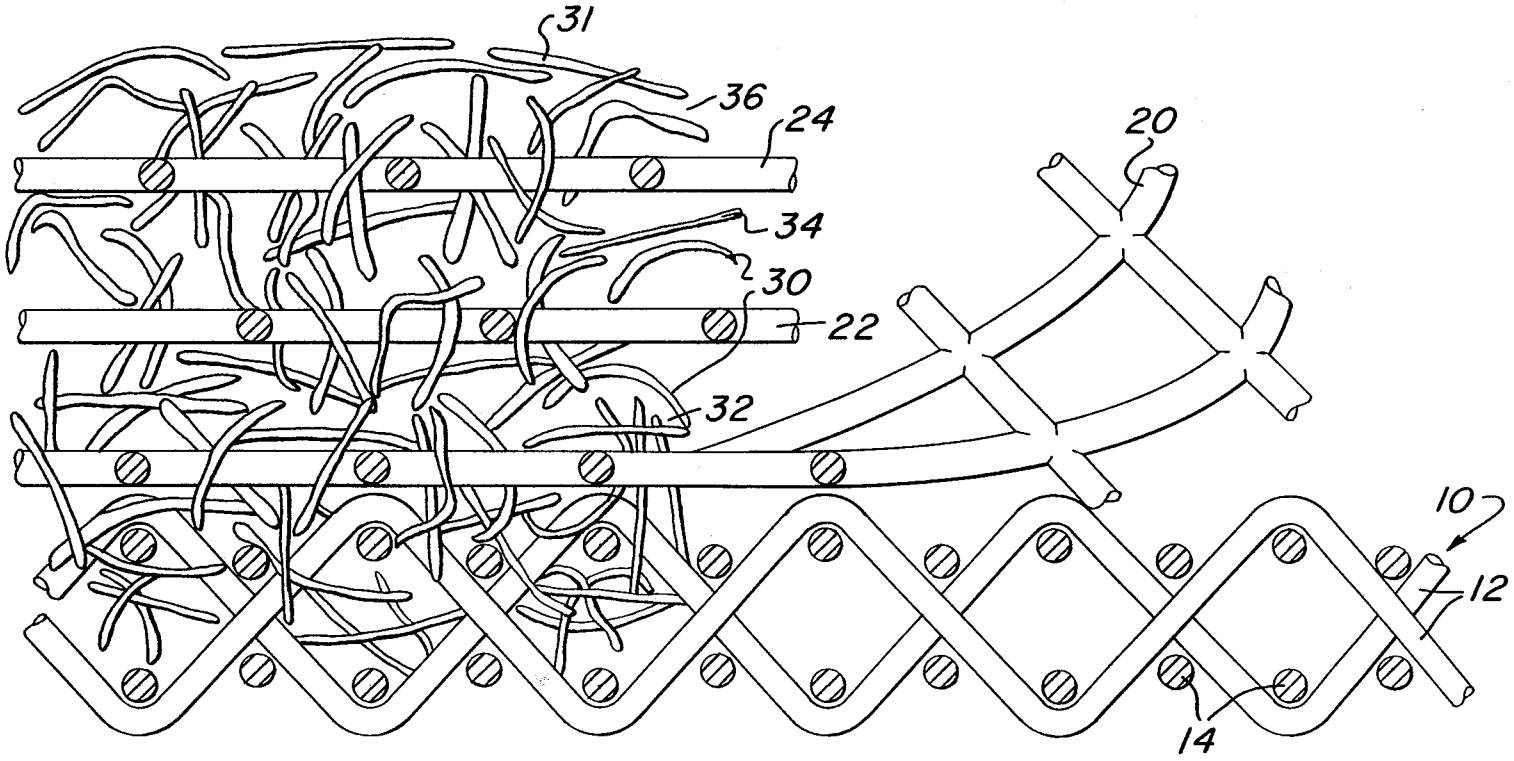
10
12
14
20
22
24
30
31
32
34
36

SUPERIMPOSED WET PRESS FELT

BACKGROUND OF THE INVENTION

The present invention relates to a felt for papermaking machines and more particularly to a multi-layer felt for use in the wet press section of a papermaking machine.

A number of attempts have been made to provide a construction particularly suitable for use in the wet press section of a papermaking machine. In the construction of a wet press felt, the desirability of maintaining a controlled void volume within the felt is recognized. In use, loss of void volume due to compaction of a wet press felt upon repeated passes through the nip of wet press rollers is common. The compaction of the wet press felt shortens the life of the felt by limiting the drainage of water through the felt. This also reduces the efficiency of the papermaking machine. As papermaking machines have developed, machine felt speeds of between 4000 and 5000 feet per minute have become common. Due to such high speeds, the resulting forces on the felt can also shorten the life of the felt if the felt is not sufficiently resistant to such loads.

Typical prior art wet press felts have included a woven fabric base to which is affixed a batt material. See, for example, the description given in U.S. Pat. Nos. 4,520,059; 4,503,113; 4,482,601, 4,461,803, 4,425,392; 4,356,225; 4,187,618; and 3,772,746.

Wet press felts which include support or filling material within the batt layers are known. For example, U.S. Pat. No. 4,357,386 discloses a composite papermaker's felt made up of a woven textile base layer, an intermediate layer of polymeric resin foam and a covering layer of non-woven batt material. U.S. Pat. No. 4,500,588 discloses a felt for papermaking which includes a woven support fabric and a non-woven fiber batt layer needled to the support fabric which includes a resinous or elastomeric air permeable filling within the layer of batt material. U.S. Pat. No. 4,427,734 discloses a wet press felt which includes a woven fabric base having layers of non-woven batt material needled thereto in which layers of synthetic textile fiber mesh are interposed between adjacent layers of the batt material.

Canadian Patent No. 691,463 discloses a papermaker's felt which comprises an open mesh woven fabric base having layers of felt or fiber material needled to both sides. The felt layer optionally includes meltable or shrinkable fiber dispersed within the felt layer so that upon heating, interconnection of the layers is increased. U.S. Pat. Nos. 4,528,236 and 4,579,771 disclose a papermaker's fabric which include a base of intermeshed monofilament spiral coils and an upper layer of batt material. The batt layer is adhered to the base by a layer of adhesive applied to the interface or by dispersing meltable fibers throughout the batt layer so that upon heating, the batt layer adheres to the base.

SUMMARY OF THE INVENTION

The present invention provides a wet press felt for use on a papermaking machine which has enhanced compaction resistance and increased void volume while exhibiting a higher resistance to load. The wet press felt of the present invention comprises a woven fabric base, a synthetic net layer oriented adjacent the fabric base and non-woven synthetic batt material affixed to the base and net layer. A plurality of layers of batt material may be employed with layers of net material interposed between adjacent batt layers. The orientation of a synthetic mesh layer between the woven fabric base and the batt material and between adjacent layers of batt material increases the void volume of the wet press felt, increases the resistance of the felt to compaction and creates a higher resistance to load. An outer layer of fabric mesh may be included to provide an enhance finish for the paper to be produced.

The woven fabric base of the present invention may comprise a single layer or a multi-layer textile fabric. The batt layers and interposed fabric mesh layers may be fixed to the woven fabric base by needling, sewing or a combination of sewing and needling in a manner as would be well known in the art. See, for example, U.S. Pat. No. 3,772,746.

BRIEF DESCRIPTION OF THE DRAWINGS

FIG. 1 is a cross sectional, side view of a portion of a wet press felt according to the present invention partially separated.

DESCRIPTION OF THE PREFERRED EMBODIMENT

With reference to FIG. 1, the wet press felt of the present invention includes a woven fabric base 10. The woven fabric base includes machine direction yarns 14 which are interwoven with cross machine direction yarns 12. The woven fabric base 10 of the present invention may comprise a single layer woven fabric or a multi-layer woven fabric as shown in FIG. 1. A variety of weave patterns suitable for use as a base fabric for a wet press felt will be known to those skilled in the art. Oriented adjacent woven base fabric 10 is a first layer of fabric mesh 20. The mesh fabric 20 is preferably a net-like structure formed from synthetic, polymeric resins in a manner well known to those skilled in the art. The mesh structure may be a series of open squares as shown, or may comprise a series of any other open geometric shapes such as rectangles or other polygons. The mesh fabric 20 preferably has a mesh size of from about 4 to about 64, that is, from about 4 to about 64 opening per linear inch. The mesh fabric 20 is preferably formed from a thermoplastic resin such as polyolefin, polyethylene, polyester, polyamide or polyurethane having a lower melt point than the batt material 30 described below.

A combination is formed by orienting fiber mesh layer 20 adjacent base fabric 1. Affixed to the combination of base fabric 10 and fiber mesh 20 are batt materials 30. The batt materials 30 are preferably formed in a plurality of layers 32, 34, and 36 which are affixed to the woven base 10 and fabric mesh 20 combination by needling. Interposed between adjacent layers 32, 34 and 36 of the batt material 30 are additional fabric mesh layers 22 and 24. The batt layers 32, 34 and 36 and mesh layers 20, 22 and 24 are affixed to the woven base layer 10 in a suitable manner, such as by needling. If preferred, the batt layers 32, 34 and 36 may be preformed as by needling, sewing or a combination of needling and sewing.

An additional layer of fiber mesh (not shown) may be oriented on batt layer 36 to provide an outer surface which gives an enhanced finish for the paper to be produced. Such an outer fiber mesh layer will typically have a fine mesh count, approaching a 64 mesh, to provide a smooth outer surface for the felt.

If the fiber mesh layers 20, 22 and 24 are formed from a thermoplastic material having a lower melt point than the batt material 30, anchorage of the batt material fibers 31 to the woven base 10 and fabric mesh layers 20, 22 and 24 may be enhanced by heating of the felt after formation. Additionally, thermoplastic fibers (not shown) may be dispersed within the batt layers 32, 34 and 36 to further enhance anchorage of the layers upon heating.

The use of layers of thermoplastic fiber mesh 20, 22 and 24 to enhance anchorage of the batt materials 30 to the woven base 10 is a particular advantage when certain fibers are employed. Fibers such as carbon, graphite, ceramic and aramids are difficult to interlock by needling. The use of such fibers can, however, increase the chemical and burn resistance of a papermakers felt. The interlayer anchorage of a papermakers felt including these fibers can be enhanced by employing a thermoplastic fabric mesh between adjacent layers. Thermoplastic fibers interspersed among the fibers of the batt layers, or within layers of such hard to needle fibers may also be employed to aid adherence. For example aramid or carbon fibers could be oriented on the surface of the felt on top of a layer of thermoplastic mesh so that adherence resulting from needling could be increased by heating to thermally adhere the fibers to the mesh.

The use of fiber mesh layers 20, 22 and 24 between the woven base fabric 10 and between adjacent layers of batt material 32, 34 and 36 increases the void volume of the felt. The fiber mesh layers 20, 22 and 24 control compaction of the layers during the needling operation as well as during use by controlling intermingling of the layers. Finer mesh counts, approaching 64, have the greatest control, however, they still permit the necessary fiber migration to bind the respective batt layers. The control of layer unity results in an increased void volume as well as a felt in which the void volume remains relatively contstant throughout the life of the felt.

In accordance with the present invention, it is possible to develop a fabric having various characteristics at different levels thereof. For instance, a coarse, relatively open base fabric may be covered by a fine mesh which will prevent excess fiber migration into the base fabric 10 during the needling operation. Furthermore, the fine mesh will prevent excess fiber migration and compaction during use. Depending on the application, a fine denier fiber batt 32 may be applied over the fine mesh layer 20 or a coarse denier fiber batt may be applied. In the instance of the fine denier batt, the mesh will prevent excess migration of the finer denier into the open area of the base fabric 10 during needling and from compaction during use. As the felt passes through the nip of the press, relaxation of the base fabric 10 will draw moisture away from the finer batt layer 32. A similar situation develops with a coarser batt layer 32. The fine mesh prevents excess fiber migration during needling and compaction, however, it does not impair the drawing off of moisture from batt layer 32 when the fabric is released from the nip. Similar considerations are made in selecting the mesh count of mesh layers 22 and 24 and the denier of the batt materials 34 and 36. From this example, it should be clear that the mesh layers 20, 22 and 24 will not substantially alter the drainage characteristics, moisture absorption and/or air permeability of the batt layers.

However, the present invention will provide the felt designer with opportunity to combine layers of different mesh counts and different batt deniers to select various characteristics at different levels of the felt. In addition to allowing the selection of different felt properties at different levels, the present invention provides the felt designer with the opportunity to select a surface batt 36 which is consistent with desirable paper quality characteristics and interior batt characteristics, layers 32 and 34, which may be more consistent with the thermal requirement of the papermaking apparatus. Special attention can be given to moisture profiles and air permeability through the felt. If desired, the present invention may also be utilized to produce felts which have selected moisture profiles and air permeability in the inner layers while presenting a sculptured or embossing upper layer 36.

The wet press felt of the present invention may be formed in varying thicknesses by varying the number of batt layers and interposed fiber mesh layers which are affixed to the woven base-fiber mesh combination. By varying the number of layers, and, thus, the overall thickness of the wet press felt, the properties of the wet press felt can be varied to provide a felt having preselected properties of increased void volume and strength with little or no rewetting.

It should be understood that the foregoing description and drawings of the invention are not intended to be limiting, but are only exemplary of the inventive features which are defined in the claims.

I claim:

1. A method of forming a papermakers wet press felt for use in a papermaking machine which comprises the steps of:

(a) providing a woven base fabric;

(b) providing a contiguous layer of synthetic, polymeric resin netting upon said base fabric;

(c) providing a non-woven fiber batt layer upon said layer of netting; and (d) fixing said batt layer to said netting layer and said base fabric.

2. The method of claim 1 wherein a plurality of layers of non-woven fiber layers are provided and a layer of said netting is interposed betwen adjacent layers of said non-woven fiber layers.

3. The method of claim 1 wherein said non-woven fiber batt layers are affixed to said woven base fabric and said fiber netting by needling.

4. The method of claim 1, wherein said non-woven fiber batt layers are affixed to said woven base fabric by sewing and needling.

5. The method of claim 1, wherein said non-woven fiber batt layers have a higher melt temperature than said netting layers whereby said fiber batt layers are affixed to said netting layers by sewing, needling or heating.

6. The method of claim 5, wherein said netting layers are a thermoplastic material selected from the group consisting of polyolefin, polyethylene, polyurethane, polyamide and polyester.

7. The method of claim 5 wherein said non-woven fiber batt layers include thermoplastic fibers dispersed therein.

8. A wet press felt comprising:

(a) a woven base fabric;

(b) a layer of a synthetic, polymeric resin netting having a mesh count per linear inch of between 4 and 64;

(c) said netting layer being contiguous with said base fabric; and (d) a layer of batt material disposed upon said netting layer and affixed to both said netting layer and said base fabric.

9. The wet press felt of claim 8 further comprising a plurality of said batt layers with a layer of said netting interposed between adjacent layers thereof.

10. The wet press felt of claim 8 wherein said batt layer is needled to said base fabric.

11. The wet press felt of claim 8 wherein said netting layer has a lower melt temperature than said batt material.

12. The wet press felt of claim 11, wherein said netting is comprised of a thermoplastic material selected from the group consisting of polyolefin, polyethylene, polyurethane, polyamide and polyester.

13. The wet press felt of claim 11 wherein said batt material further includes thermoplastic fibers dispersed therein.

14. The wet press felt of claim 8, further having said netting oriented on both sides of said batt material.

15. A papermakers wet press felt for use in a papermaking machine comprising:

(a) base fabric comprised of a plurality of interconnected monofilament yarns;

(b) a layer of non-woven batt material;

(c) a layer of synthetic, polymeric resin netting having a mesh count per linear inch of between 4 and 64;

(d) said netting layer contiguous with said base fabric and sandwiched between said base fabric and said batt layer; and (e) said batt layer being fixed to said netting layer and said base fabric.

* * * * *

UNITED STATES PATENT AND TRADEMARK OFFICE

CERTIFICATE OF CORRECTION

PATENT NO. : 4,798,760

DATED : January 17, 1989

INVENTOR(S) : Michelle A. Diaz-Kotti

It is certified that error appears in the above-identified patent and that said Letters Patent is hereby corrected as shown below:

Column 2, line 49, reference numeral "1" should be --10--.

Column 2, line 58, the word "suitablc" should be --suitable--.

Column 4, line 45, the word "fiber" should be deleted.

Signed and Sealed this

Thirteenth Day of June, 1989

*Attest:*

DONALD J. QUIGG

*Attesting Officer*

*Commissioner of Patents and Trademarks*